US006698229B2

(12) United States Patent
Renken et al.

(10) Patent No.: US 6,698,229 B2
(45) Date of Patent: Mar. 2, 2004

(54) LOW VOLUME BEVERAGE DISPENSER

(75) Inventors: Richard K. Renken, Chesterfield, MO (US); Timothy J. Kraus, Two Rivers, WI (US); Philip M. Krebs, West Linn, OR (US); O. Richard Kyees, Yorba Linda, CA (US); Melvin D. Kyees, Huntington Beach, CA (US)

(73) Assignee: Manitowoc Foodservice Companies, Inc., Manitowoc, WI (US)

( * ) Notice: Subject to any disclaimer, the term of this patent is extended or adjusted under 35 U.S.C. 154(b) by 0 days.

(21) Appl. No.: 10/236,474

(22) Filed: Sep. 6, 2002

(65) Prior Publication Data

US 2003/0066306 A1 Apr. 10, 2003

Related U.S. Application Data

(60) Provisional application No. 60/317,811, filed on Sep. 6, 2001.

(51) Int. Cl.[7] ..... B67D 5/62

(52) U.S. Cl. ..... 62/390; 62/129.1

(58) Field of Search ..... 222/129.1, 146.6; 62/389, 390

(56) References Cited

U.S. PATENT DOCUMENTS

| | | | |
|---|---|---|---|
| 2,519,235 | A | 8/1950 | Dole |
| 2,607,519 | A | 8/1952 | Sanborn |
| 2,612,357 | A | 9/1952 | Parks |
| 3,011,323 | A | 12/1961 | Jaeger |
| 3,331,536 | A | 7/1967 | De Lorenzo |
| 4,617,807 | A | 10/1986 | Pritchett et al. |
| 4,651,538 | A | 3/1987 | Bull et al. |
| 4,678,104 | A | 7/1987 | Pritchett |
| 4,781,309 | A | 11/1988 | Vogel |

(List continued on next page.)

FOREIGN PATENT DOCUMENTS

| | | |
|---|---|---|
| CA | 643489 | 6/1962 |
| GB | 2 194 508 A | 3/1988 |

OTHER PUBLICATIONS

International Search Report, dated May 8, 2003, for corresponding international application No. PCT/US02/28307.

*Primary Examiner*—William E. Tapolcai
(74) *Attorney, Agent, or Firm*—Brinks Hofer Gilson & Lione

(57) ABSTRACT

An apparatus for low volume dispensing of soft drinks preferably uses no mechanical refrigeration equipment, depending instead on heat transfer from a bin of ice to cool water and soft-drink syrup for beverages. A heat-exchange plate desirably includes transfer lines for incoming water to and from a carbonator. A portion of the heat exchange plate, or a second heat exchange plate, includes transfer lines for syrup and for carbonated water. The carbonated water is used to cool the syrup through the second heat exchange plate, and is also mixed with the syrup to dispense a soft drink. Heat from the incoming water and syrup is removed by melting ice in the ice bin, which may be replenished as needed.

25 Claims, 8 Drawing Sheets

U.S. PATENT DOCUMENTS 4,848,418 A 7/1989 Rudick et al.
4,958,505 A 9/1990 Swanson
4,969,576 A 11/1990 Merrill et al.
4,979,647 A * 12/1990 Hassell ..... 222/146.6
5,033,645 A 7/1991 Shannon et al.
5,080,261 A 1/1992 Green
5,104,007 A 4/1992 Utter
5,163,298 A 11/1992 Hassell et al.
5,165,255 A 11/1992 Alvarez et al.
5,190,188 A 3/1993 Credle, Jr.
5,226,296 A 7/1993 Kolvites et al.
5,230,448 A * 7/1993 Strohmeyer et al. ..... 222/643
5,245,841 A 9/1993 Paul et al.
5,249,710 A * 10/1993 Hassell et al. ..... 222/146.6
5,279,446 A 1/1994 Cook et al.
5,319,947 A * 6/1994 Fischer ..... 62/389
5,335,705 A 8/1994 Morishita et al.
5,350,086 A 9/1994 Martin et al.
5,368,198 A 11/1994 Goulet
RE34,834 E 1/1995 Swanson
5,487,492 A 1/1996 Goulet
5,499,744 A 3/1996 Hawkins
5,524,452 A * 6/1996 Hassell et al. ..... 62/389
5,542,572 A 8/1996 Davis
5,542,573 A 8/1996 Frantz
5,549,219 A 8/1996 Lancaster
5,660,307 A 8/1997 Schroeder et al.
5,743,107 A 4/1998 Kyees
5,743,602 A 4/1998 Maddux et al.
5,829,646 A 11/1998 Schroeder et al.
5,950,866 A 9/1999 Lancaster
6,045,007 A * 4/2000 Simmons ..... 222/146.6
6,152,325 A 11/2000 Edwards
6,209,339 B1 4/2001 Schroeder et al.
6,266,945 B1 7/2001 Schroeder
6,286,720 B1 9/2001 Simmons et al.
6,299,026 B1 10/2001 Jaleel et al.
6,305,177 B1 10/2001 Edwards et al.
6,321,802 B1 11/2001 Weeks et al.
6,324,850 B1 12/2001 Davis
6,343,481 B2 2/2002 Simmons et al.
6,463,753 B1 * 10/2002 Haskayne ..... 62/389
6,505,758 B2 * 1/2003 Black et al. ..... 222/146.6

* cited by examiner

LOW VOLUME BEVERAGE DISPENSER

This application claims the benefit of the filing date under 35 U.S.C. § 119(e) of Provisional U.S. Patent Application Ser. No. 60/317,811, filed on Sep. 6, 2001, which is hereby incorporated by reference in its entirety.

BACKGROUND OF THE INVENTION

Soft drink dispensers are widely used to dispense drinks in a variety of establishments. Fast-food outlets, roadside convenience stores, re-fueling stations, and cafeterias are examples of locations involving high volume consumption of soft drinks. Because of the high volume, these dispensers must have sophisticated systems for storing and delivering the components expected in a soft drink: ice, water (carbonated or non-carbonated), and syrup, the latter two in a properly-mixed proportion. Water and syrup should be cooled before being dispensed, and ice must be made or at least delivered in large quantities. Such high volume dispensers require considerable installation time and tend to be large and expensive, with undercounter or backroom storage of pressurized syrup tanks and associated tubing, and heat exchangers chilling the water and syrup to the precisely desired degree in time for dispensing and serving.

A facility with lower volume requirements does not need such an expensive and sophisticated system, but may still wish to deliver the authentic taste of a freshly-mixed ("post-mixed") carbonated or non-carbonated drink. In this case what is needed is a low-volume soft-drink dispenser, costing much less and requiring less of a "footprint" area for its placement on the floor of a kitchen, a cafeteria or a break area. What is needed is a low-volume soft drink dispenser, delivering post-mixed soft drinks made from syrup and carbonated or non-carbonated water. The dispenser should deliver the drinks chilled as customers prefer, and should also provide an amount of ice desired by a customer or user with the drink.

SUMMARY OF THE INVENTION

In order to address these deficiencies of the prior art, a low volume soft drink dispenser has been invented. In a first aspect of the invention, a beverage dispenser includes a housing. An ice bin is in the housing and there is at least one heat exchanger within the housing in thermal contact with the ice bin. Within the housing is space configured to receive at least one container of beverage syrup. There is also a carbonator within the housing for making carbonated water, and at least one mixing and dispensing valve for mixing and dispensing carbonated water and syrup. The dispenser is configured to receive ice, syrup, water and carbon dioxide, chill the water and the syrup by exchanging heat with melting ice. The mixing valve mixes the syrup and carbonated water and dispenses a soft drink.

A second aspect of the invention is a beverage dispenser in a housing. Within the housing is a carbonation system, the carbonation system comprising a carbonator and a source of carbon dioxide. The beverage system also includes a water system, comprising a source of water and a charging pump for charging water to the carbonator, and a circulation pump for circulating water. The dispenser includes a cooling system, comprising an ice bin, a first heat exchanger for exchanging heat between ice in the ice bin and water, and circulating carbonated water produced by the carbonation system, and a second heat exchanger for exchanging heat between said syrup and said circulating carbonated water. The dispenser also includes a source of syrup, located in a space within the housing configured to receive at least one container of syrup. The dispenser also includes a dispensing system, comprising at least two mixing and dispensing valves and interconnecting lines between the valves, the source of water and the source of syrup. At least one of said two mixing and dispensing valves receives syrup and carbonated water.

In another aspect, an embodiment of the invention is a method of producing and dispensing a beverage, the method comprising cooling water through ice in thermal contact with a first heat exchanger and circulating said water through a second heat exchanger; cooling syrup in the second heat exchanger; mixing the cooled syrup and water to form a beverage; and dispensing the beverage.

Another aspect of the invention is a beverage dispenser comprising a tower heat exchanger and at least one mixing and dispensing valve connected to the tower heat exchanger. The tower heat exchanger comprises at least one coil of syrup tubing and at least one coil of cooling fluid tubing embedded within a metallic body, each coil having two ends protruding from the metallic body, the cooling fluid coil ends being connected to a source of circulating cooling fluid, and a first of said ends of the syrup tubing each being connected to a source of syrup. The at least one mixing and dispensing valve is connected to the tower heat exchanger, wherein a second of said ends of the syrup tubing are each connected to the mixing and dispensing valves.

Another aspect of the invention is a beverage dispensing tower. The beverage dispensing tower comprises a generally horizontal top bar on which a plurality of mixing and dispensing valves are attached and arranged to dispense a beverage generally downwardly. The tower also comprises two side supports holding the top bar in a raised position so that a cup can be placed under each of the mixing and dispensing valves. The tower has a generally inverted "U" shape such that the area under the top bar is open.

Another aspect of the invention is a beverage dispenser comprising a split heat exchanger having a first part and a second part. The dispenser has an ice bin in thermal contact with said first part and a pump circulating a cooling fluid between said first part and said second part. A source of beverage syrup is connected to the second part. The first part transfers heat from circulating cooling fluid to ice in the ice bin and the second part transfers heat from a beverage syrup to the circulating cooling fluid.

Another aspect of the invention is a beverage dispenser. The beverage dispenser comprises a heat exchanger comprising at least one tubing coil carrying syrup and at least one tubing coil carrying cooling fluid embedded within a metallic body, each coil having two ends protruding from the metallic body, the cooling fluid coil ends being connected to a source of circulating cooling fluid, a first of said ends of the syrup-tubing being connected to a source of syrup. The beverage dispenser also comprises at least one mixing and dispensing valve connected to the heat exchanger, the second of said ends of the syrup tubing being connected to said at least one mixing and dispensing valve, with water and the syrup being combined in the mixing and dispensing valve to produce a beverage. The beverage dispenser also comprises at least one beer tubing coil within said metallic body for cooling beer, one end of the beer coil connected to a source of beer and the other end connected to a dispensing valve connected to the heat exchanger.

Major advantages of preferred embodiments of the invention include quicker installation and less space required for installation. Such advantages may be realized at least partly because of smaller bag-in-box (BIB) containers, such as 3-gallon containers rather than 5-gallon containers. The dispenser housing, with BIB containers inside, reduces plumbing requirements, since volumetric ratio valves may be used rather than syrup pumps. Carbon dioxide may be supplied from a remote location, or may be placed within or on the housing to further reduce plumbing and installation costs.

Other advantages include the fact that beverage syrup in the preferred embodiments of these beverage dispensers is not under pressure, but flows to a driven volumetric ratio valve under the driving force of carbonated water driving a companion driving valve. This is only possible if the BIB containers are close to the volumetric ratio valve. Syrup for beverages is contained within a reservoir of tubing inside the cold plate heat exchanger. The syrup is kept cold for a low temperature casual draw as low as 36° F. The cold plate may be made thinner or thicker as desired by designing the cooling and syrup coils for smaller or greater capacity, respectively.

The low volume beverage dispenser and the tower heat exchanger have other advantages. Because of the close proximity between the mixing and dispensing valves and the tower cold plate heat exchanger, there is virtually no dead space between the cooled syrup and the mixing and dispensing valves, less than 2 inches (5 cm). This enables a user to mix and dispense a cold drink even when the dispenser has not been used for a period of time. The tower heat exchanger also allows for a manifold of carbonate water that serves as many different mixing and dispensing valves as desired, again without the bother of separate lines or additional plumbing. Finally, the pairs of syrup coil ends and water/carbonated water coil or manifold connections are spaced apart in the tower heat exchanger for standard block valves and standard mixing and dispensing valves.

DETAILED DESCRIPTION OF THE PREFERRED EMBODIMENTS

Figure 1:
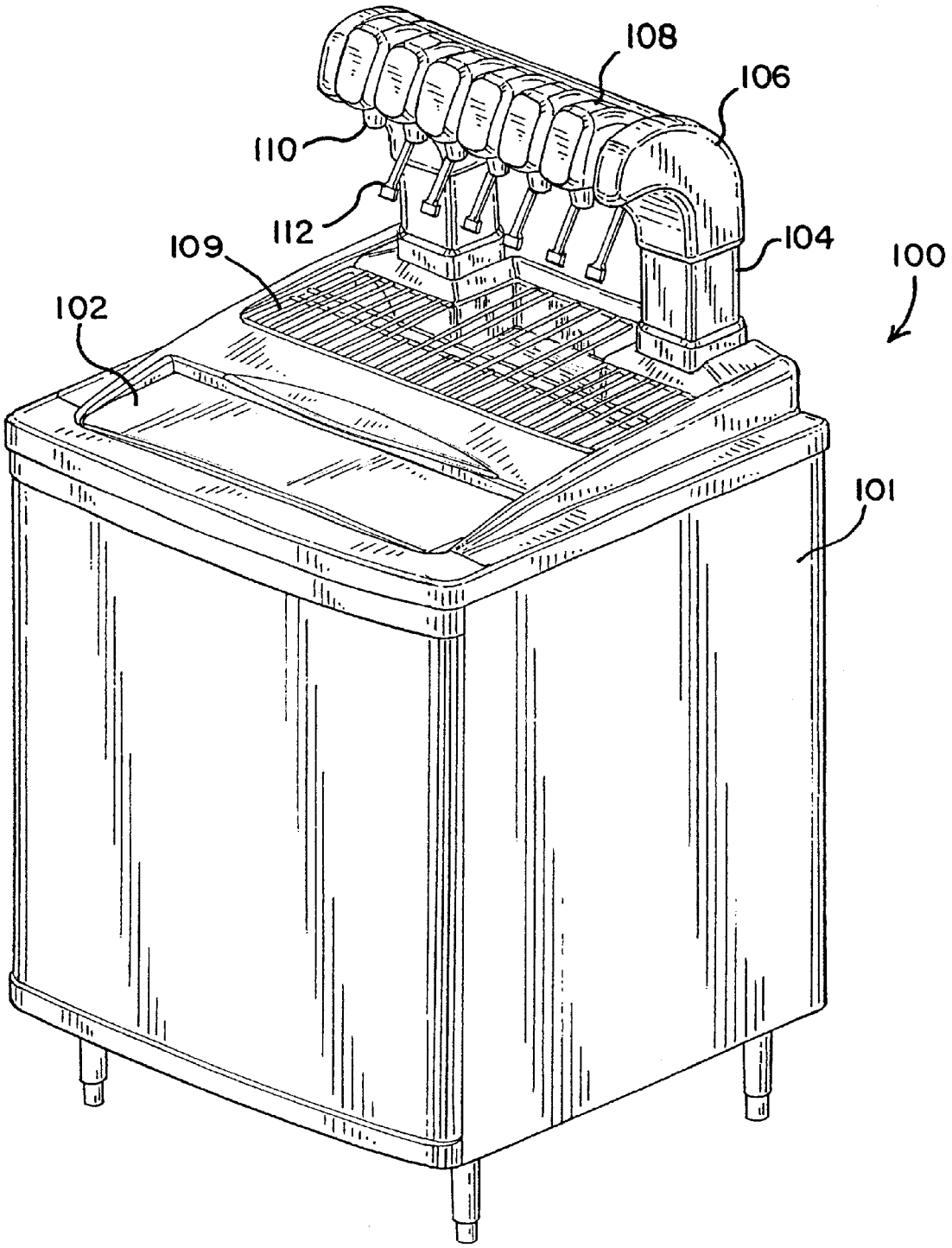
FIG. 1 is a perspective view of a preferred low-volume beverage dispenser of the present invention.
Figure 4:
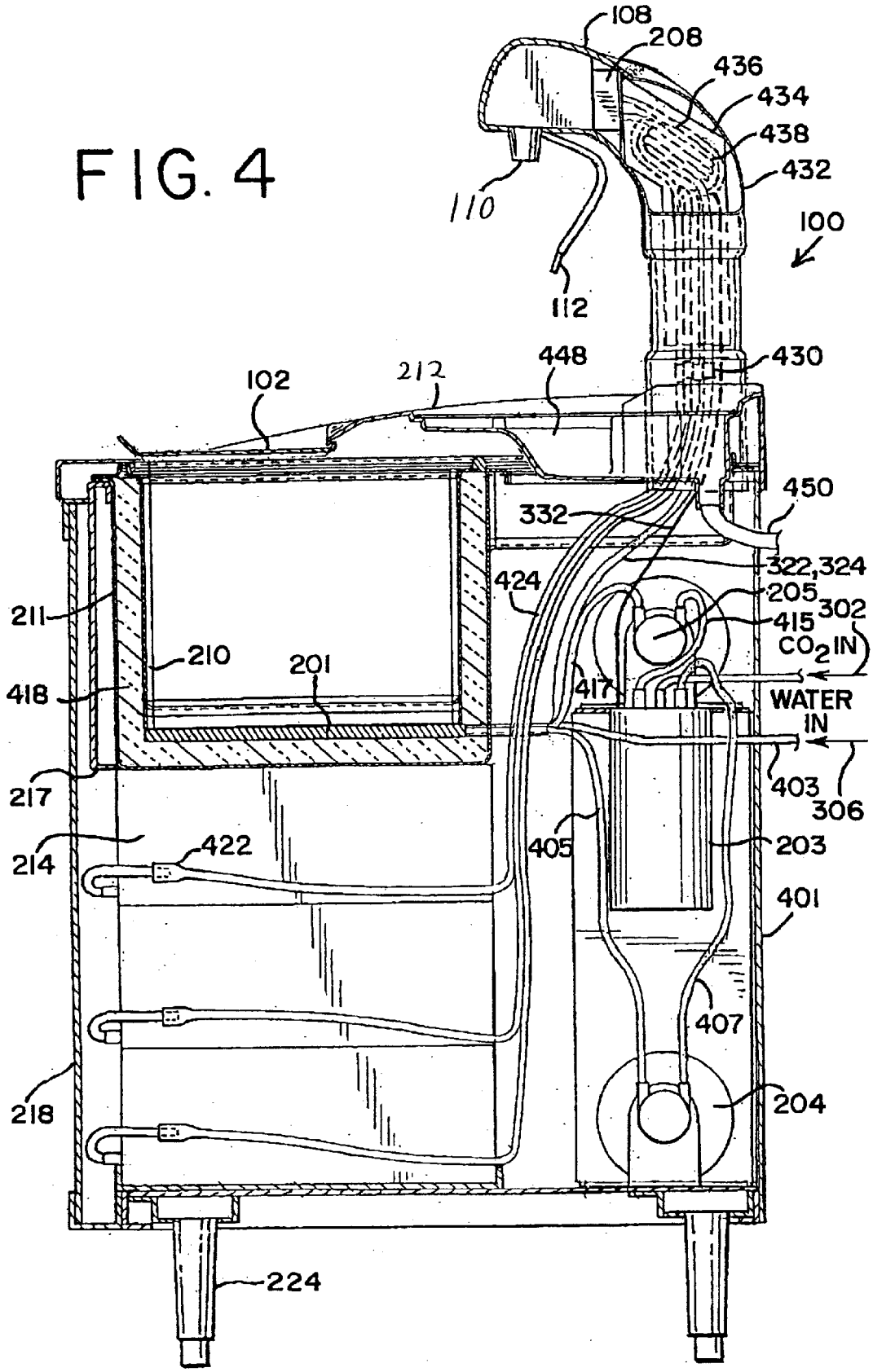
FIG. 4 is a partial sectional view of the low-volume beverage dispenser of FIG. 1.

FIG. 1 is a perspective view of a low-volume beverage dispenser 100. The dispenser has a housing or cabinet 101 and a tower 104 portion. The housing also features a door 102 for access to an ice bin, whereby a consumer opens the door and either fills the bin or serves ice to himself or herself. The tower 104 includes a heat exchanger for cooling syrup (described in detail below), an insulation cover 106, and one or more mixing and dispensing valves 108 used to mix carbonated or non-carbonated water and soft-drink syrup. Six valves are depicted in FIG. 1. The beverage is dispensed from a nozzle 110, typically after actuation by a user placing a cup into actuator 112 and pressing. The user then dispenses the desired amount of drink. Any spills or drips fall through grill 109 onto a surface 448 and flow out through a drain 450 (FIG. 4).

Figure 2:
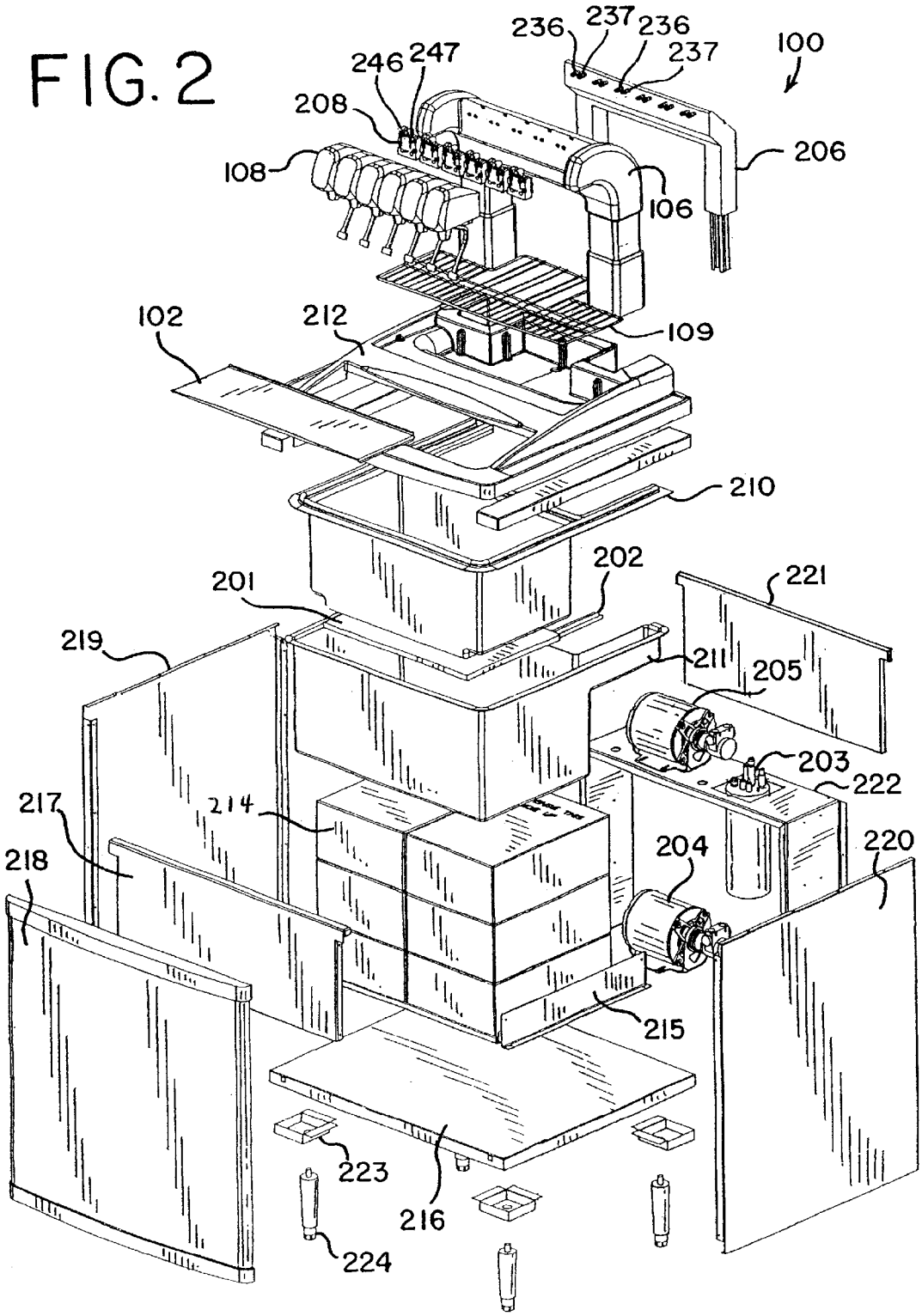
FIG. 2 is an exploded view of the low-volume beverage dispenser of FIG. 1.
Figure 3:
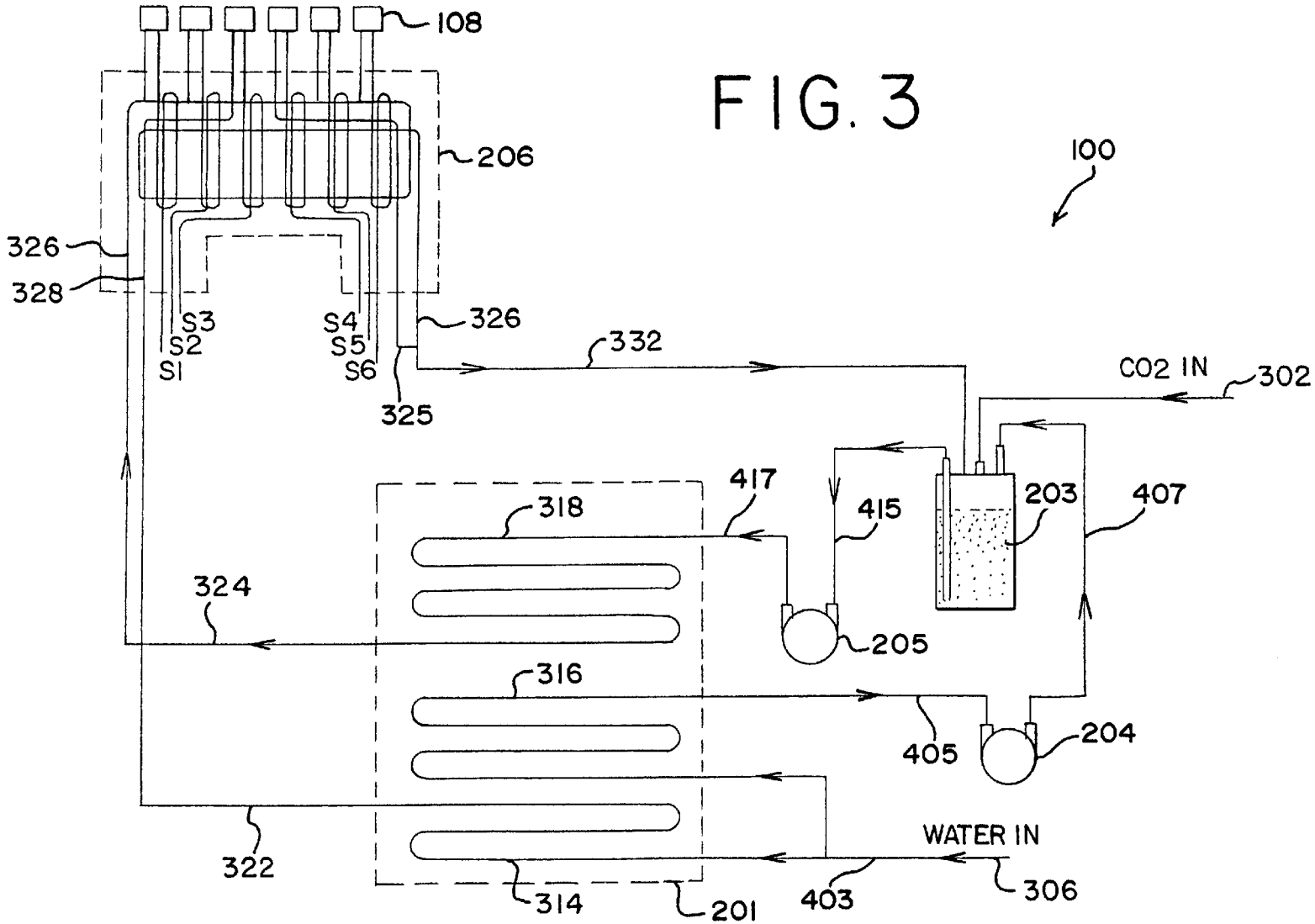
FIG. 3 is a schematic diagram of the water and syrup systems of the beverage dispenser of FIG. 1.

FIG. 2 is an exploded view of the low-volume beverage dispenser 100, with the back of the housing and most of the liquid and electrical lines not shown for sake of clarity. FIG. 3 shows the liquid lines in schematic form. The dispenser 100 includes a first heat exchanger 201, also referred to as the primary heat exchanger or primary cold plate. This first heat exchanger has a fitting 202 for connection to an incoming water line 306. Part of the water exiting the first heat exchanger may be routed to a carbonator 203 that is fitted for an incoming carbon dioxide line. The carbonator mixes water with carbon dioxide to make carbonated water. Charging pump 204 charges the water from the heat exchanger (or other incoming water) to carbonator 203. A re-circulation pump 205 connects to the carbonator 203 and pumps carbonated water back to first heat exchanger 201, from which it travels to a second heat exchanger 206 and back to the pump 205. Second heat exchanger 206, also referred to as the tower heat exchanger or tower cold plate, may be insulated by a thermal insulation, such as a thermally-resistant thermoplastic or thermoset material. Other insulators may also be used, such as fiberglass or other material having resistance to the passing of heat. Cover 106 provides part of the insulation. In some embodiments, it may be preferable to provide a carbon dioxide container or cylinder within the housing or mounted outside the housing. Alternately, a carbon dioxide cylinder or source may be provided very close to the low volume beverage dispenser to minimize plumbing costs and to minimize logistical efforts.

Block valves 208 (FIG. 2) may connect with second heat exchanger 206 for mounting mixing and dispensing valves 108. In one embodiment, there are six block valves 208, one for each of six mixing and dispensing valves 108, each for a different flavor of soft drink. A preferred block valve is one sold as Model 380Q by Flomatic Corp., Sellersburg, Ind. One or more of the mixing and dispensing valves 108 may be used for dispensing non-carbonated beverages, such as water or lemonade. Each block valve 208 has two passages 246, 247 used for syrup and carbonated water, or non-carbonated water respectively, when mixing and dispensing a soft drink. Block valve 208 receives the syrup and carbonated water from a pair of protruding ends 236, 237 of coils within the tower heat exchanger 206. The block valve allows passage of the fluids to mixing and dispensing valves 108. The coils are typically bent tubing made from stainless steel. The coils may have one turn or a plurality of turns to enhance heat transfer by providing a larger surface area for the heat transfer between fluids within the coil and the heat exchanger. Some of the coils may also be in a serpentine shape rather than having one or more turns.

In one embodiment, one end 236 is an end of a syrup cooling coil within the heat exchanger 206 and the other end 237 is an end of a manifold or circulating line of carbonated water within the heat exchanger 206. For beverages not requiring carbonated water, another pair of protruding ends 236, 237 are from cooling coils for water and lemonade concentrate, or from other desired beverage not requiring carbonated water. For beverages requiring only one fluid, a different block valve may be used, or only one passage may be used, e.g. water.

Resting atop first heat exchanger 201, which is preferably an aluminum cold plate, is ice bin 210. The heat exchanger 210 forms the bottom of ice bin 210. Ice bin 210 contains ice (not shown) for users to scoop into drink cups. The ice also cools the first heat exchanger 201, thus acting as the heat sink for heat rejected from the incoming water and syrup. First heat exchanger 201 and ice bin 210 may be contained within insulation 418 between the ice bin 210 and a holder 211 (FIG. 4). The ice bin 210 also has cover 212 with removable door 102 so that a person desiring ice may remove the door and self-dispense ice for a beverage.

The remainder of FIG. 2 shows the various components of the housing 101 used for the dispenser 100. There is room within the housing for at least one container of soft-drink syrup. FIG. 2 depicts six bag-in-box (BIB) containers 214 of syrup. The containers may rest on a single shelf 215 or on a rack (not shown) for easy replacement. The dispenser has a bottom 216, a front bezel 217, a front panel 218, which preferably is hinged to the rest of the housing to provide access to the syrup storage space, a left side panel 219, a right side panel 220, and a back bezel 221. The back panel 401 is not shown in FIG. 2, but can be seen in FIG. 4. A mounting bracket 222 provides a mount for carbonator 203 and pumps 204, 205. The dispenser may also include leg supports 223 and legs 224. In other embodiments, wheeled legs may be used, such as small wheels or casters, so that the dispenser is easily movable from one location to another.

As best seen in FIG. 3, carbon dioxide line 302 provides carbon dioxide to carbonator 203. A water line 306 leads to first heat exchanger 201. The water line may be split into two portions, 314, 316 as shown, in a tee fitting before the heat exchanger 201, or the lines may be split after passing through the heat exchanger, or a tee may be built into tubing incorporated within the heat exchanger itself. The purpose of having two lines is to provide water for two purposes, pre-chill line 316 for charging through water pump 204 to the carbonator 203, and line 314 for providing non-carbonated water to one or more of the mixing and dispensing valves. Providing two lines in the manner depicted allows for cooling of the water through line 316 before charging to the carbonator, thus allowing for more absorption of carbon dioxide by the water. The other portion of the water line 314 allows non-carbonated water to be chilled before routing via connecting lines 322 and 328 to the second heat exchanger 206 and dispensing by one of the mixing and dispensing valves 108. Alternatively, cold water line 322 may be used to provide a "water only" beverage through one of the valves 108.

The heat exchangers 201, 206 may be two heat exchangers or may be a single larger heat exchanger having two portions, one nearer the ice bin and one nearer the dispensing valves. The first heat exchanger 201, or the first portion of the heat exchanger if there is only one, incorporates tubing or lines for incoming water 306 so that the incoming water is chilled, and also incorporates tubing or lines 318 for circulating post-chilled carbonated water from the carbonator 203 by circulation pump 205. This portion of the heat exchanger is in thermal contact with ice from the ice bin 210. Heat flows from the incoming water to the heat exchanger itself, and thence to the ice bin and ice. This process rejects heat from the incoming water to the ice of the ice bin.

The second heat exchanger 206, or the second portion of the heat exchanger if there is only one, receives water circulating from the circulating pump 205. This water is first chilled by passing through the first heat exchanger 201. In a low volume dispenser, the amount of incoming water may be small compared to the flow of water re-circulated from the carbonator. The amount of syrup used to make a beverage is lower still than the amount of water used to make a beverage (typically in a ratio of about one to five). The heat load from cooling the water is therefore greater than from cooling the syrup. While the particular routing of water depicted in FIG. 3 is not the only routing possible, it is the most efficient, since the greatest mass (incoming water) receives cooling from the coldest surface, the portion of the heat exchanger 201 in contact with the ice in ice bin 210. The syrup, a much smaller mass and thus a much smaller cooling load per drink, is cooled indirectly by circulating carbonated water through second heat exchanger 206. The principal means of rejecting heat from incoming water is through the first heat exchanger 201 and its contact with the ice in ice bin 210. The principal means of rejecting heat from the syrup is by circulating carbonated water through the second heat exchanger 206, the carbonated water in turn being chilled in the first heat exchanger 201. Water or carbonated water may be circulated for cooling. Carbonated water is preferred, as shown in FIG. 3, because the carbonated water can then come back to the carbonator and always be cold when it is used to make a drink, especially a casual drink dispensed after the dispenser has not been in use for a while. A "casual drink," as that term is used in the soft drink industry, is one that is dispensed after an irregular period of time, which may occur after a long interval from when the previous drink was dispensed, or after a very short interval: in either circumstance, the drink should be cold as dispensed.

Figure 5:
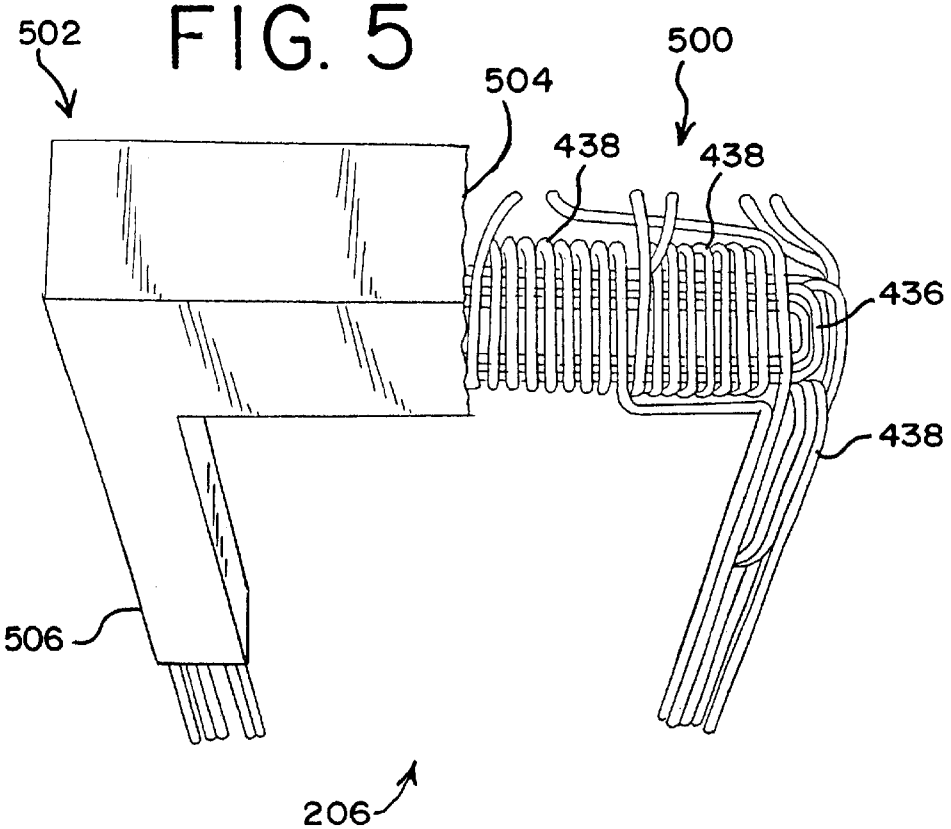
FIG. 5 is a partially broken away view of a heat exchanger used in the tower of the beverage dispenser of FIG. 1.

The second heat exchanger 206 has coil 326 interconnecting the first heat exchanger 201 via line 324 for receiving cool carbonated water, and line 332 for returning the carbonated water to the carbonator 203 for further circulating. Coil 326 is depicted as a largely rectangular, horizontal coil in FIG. 3, exchanging heat with second heat exchanger 206 before the carbonated water is returned via line 332 to carbonator 304. The second heat exchanger also has lines S1, S2, S3, S4, S5 and S6, as best seen in FIG. 5, discussed hereafter, for supplying syrup or beverage to valves 108 for dispensing into a cup of a user.

An apparatus for low volume dispensing of soft drinks preferably uses no mechanical refrigeration equipment, instead depending on heat transfer from a bin of ice to cool water and soft-drink syrup for beverages. A heat-exchange plate desirably includes transfer lines for incoming water to and from a carbonator. A portion of the heat exchange plate, or a second heat exchange plate, includes transfer lines for syrup and for carbonated water. The carbonated water is used to cool the syrup through the second heat exchange plate, and is also mixed with the syrup to dispense a soft drink. Heat from the incoming water and syrup is removed by melting ice in the ice bin, which may be replenished as needed.

The syrup lines connect to the bags or containers of syrup 214 and may have many loops of tubing or passage within second heat exchanger 206 for the purpose of rejecting heat to the heat exchanger 206 and thus to the circulating carbonated water. The syrup lines S1–S6 are depicted in FIG. 3 as generally rectangular or rounded rectangular vertical coils within second heat exchanger 206. In addition, non-carbonated water may pass through a coil embedded in the second heat exchanger, the coil in the form of a generally rectangular coil that is roughly perpendicular to the coils of the circulating water.

The syrup lines desirably have a surface area large enough for efficient cooling by heat exchanger 206. The lines are also desirably large in internal diameter, smooth and without sharp bends for low pressure drop through their passage from a syrup container through the heat exchanger and out to valve 108. Some drinks dispensed by the dispenser may not require carbonation (such as fruit juices or lemonade-type drinks). Syrup for these beverages may be cooled in coils within heat exchanger 206 that exit next to lines that provide non-carbonated water rather than carbonated water, as shown by line 322. Then both the syrup and non-carbonated water line will easily be connected through block valve 208 to mixing and dispensing valve 108. Alternatively, a beverage that is not made from a syrup, such as beer, may be delivered to a dispensing valve mounted in place of one of the mixing and dispensing valves 108, discussed below in connection with FIG. 8. The tubing for supplying such a beverage will preferably be routed through the second heat exchanger 206.

The carbonated water is cooled by the low temperature of the ice that cools first heat exchanger 201. The carbonated water then cools the second heat exchanger 206. Second heat exchanger 206 then cools the syrup drawn or pumped through lines S1–S6. This method of transferring heat will work whether heat exchanger 201 and 206 are separate heat exchangers or are a single heat exchanger with two parts. However, manufacture and assembly are more easily accomplished with heat exchangers formed as separate bodies. In addition, while FIG. 3 depicts circulating carbonated water, the invention will work as well by circulating non-carbonated water, by merely changing certain of the water lines. The carbonated water line entering the second heat exchanger 206 preferably includes a manifold so that it can supply four of the valves 108 as well as line 326 used for circulation. Line 325 is tied into line 326 to provide carbonated water to the mixing and dispensing valve 108 connected to syrup line S4. However, line 325 can be blocked and water from line 328 can be provided to this valve if two non-carbonated beverages are to be dispensed.

A source of water, as used in the present application, may be an incoming water line, such as from a municipal water supply or from a building supply utilizing soft water. A source of water may also include a co-located tank or bottle of water. A source of water may include any pipe connected to the beverage dispenser that supplies non-carbonated water. A source of carbon dioxide may include a local or nearby tank of carbon dioxide, or may include an inlet pipe that supplies carbon dioxide to the beverage dispenser. The source of carbon dioxide may include any pipe connected to the beverage dispenser that supplies carbon dioxide.

FIG. 4 is a partial cross-sectional side view of the low volume dispenser 100. The syrup, water and carbon dioxide lines are depicted in more detail. The carbon dioxide comes from a source of supply 302 and is charged directly to the carbonator 203. The water from a source of supply 306 may be routed via connecting line 403 to first heat exchanger 201, in thermal contact with ice bin 210, and insulated by at least one layer of insulation 418 from ice bin holder 211. In one embodiment, ice bin 210 and heat exchanger 201 are foamed-in-place inside holder 211 by relatively rigid insulation, such as polycyanurate or other good thermal insulation.

Water leaves the first heat exchanger and may be routed to charging pump 204 and carbonator 203 via connecting lines 405, 407. Water for consumption may also be routed via connecting line 322 to tower heat exchanger 206, depicted with insulation cover 434. Re-circulation pump 205 may take its suction 415 from the carbonator 203 and pump via line 417 to first heat exchanger 201, and then via connecting line 324 to second heat exchanger 206. In second heat exchanger 206, coil 436 circulates carbonated water and exits for re-circulation to carbonator 203 via line 332. Carbonated water for beverages may be taken from the recirculation line in the manner shown in FIG. 3.

The non-carbonated water line 328 may include one or more loops of tubing inside heat exchanger 206 if this water needs to be cooled again before being used to make a beverage. Syrups or other concentrate for beverages may be contained in one or more containers 214. The containers typically have a quick disconnect line 422 (FIG. 4) for attaching syrup lines 424 for routing to the second heat exchanger. Heat exchanger 206 has a separate coil 438 for each flavor syrup. All syrup lines 424, water line 322, and carbonated water line 324 may connect to barb fittings 430 or other fittings on the protruding ends of the coils embedded in heat exchanger 206. This allows for cleaning and replacement of lines. Block valves 208 allow the syrup and water lines exiting the second heat exchanger 206 to be closed if the mixing and dispensing valve 108 needs to be disconnected.

A user approaches the low volume dispenser and may open lid 102 and serve himself or herself by putting ice from the ice bin 210 into a cup. The user then takes the cup and presses the cup against actuator 112. Carbonated water and syrup mix in a mixing valve 108 after passing through block valve 208. The mixed drink flows generally downwardly from nozzle 110 into the cup. Spillage may collect into sump 448; the sump may be piped from drain 450 to a sink or other place of disposal.

The syrup is exposed to the very least amount of ambient environment possible. In one embodiment, the distance from the point where the syrup coils protrude from the metallic heat exchanger 206 to the mixing and dispensing valves 108 is less than about two inches, including the space from the end of coil 438 through block valve 208 to the mixing and dispensing valve 108. Keeping this distance to a minimum, and keeping heat exchanger 206 cold by constantly circulating cooling fluid (such as carbonated water) through lines 324 and 332, a user may dispense a casual drink at a temperature of 36° F. or lower.

FIG. 5 is a perspective, partially cut away view, of the tower heat exchanger 206. The figure is drawn in two parts, the left portion 502 showing a completed metallic cold plate heat exchanger, preferably made from east metal, such as aluminum. The right hand side 500 depicts the bundles or coils of tubing 436 and 438 before metal is cast around the tube bundles, which provides passages through the heat exchanger.

The heat exchanger is in the shape of an inverted "U" having a horizontal top portion 504 with two side supports 506 generally perpendicular to the top portion or top bar. In one embodiment, the side supports 506 attach to the ends of the top bar 504. The heat exchanger is desirably made of a metal useful in conducting heat, such as aluminum and alloys of aluminum. The tubing may be stainless steel tubing embedded within the metal, such as tubing that is formed into shape and then has aluminum cast around it. Tubing or fittings may also be placed within passages machined within a cold plate or tower heat exchanger 206.

The metallic body making up the heat exchanger 206 is not limited to aluminum, but may be any material suitable for conduction of heat. Aluminum is relatively light-weight with excellent thermal conductivity. Copper or other conductors, however, may also be used. Aluminum is preferred because of its excellent thermal conductivity, light weight, low casting temperature, and relatively low cost. Cast alloys of copper, bronze, brass or other materials may also be used. Casting is not required, but extensive machining and preparation of stock may be avoided by casting around already-prepared bundles of stainless steel tubing.

The tubing desirably includes syrup passages, and in the embodiment shown, may have separate tubing for six passages. The six passages may include syrups for four or five flavored carbonated beverages, and one or two non-carbonated beverage, such as lemonade or juice concentrate. The vertical portions 506 of the U each contain one of the syrup tubing coils 438, and the horizontal portion 504 contains four of the syrup tubing coils. The horizontal portion 504 of the U contains the main portion of the loop 436 for re-circulating carbonated water from the carbonator. In the embodiment depicted, the syrup coils 438 contain multiple loops. The recirculating water coil 436 forms generally horizontal loops that pass through the loops of the syrup coils 438. Circulating water lines and syrup lines in the vertical portions 506 may be coiled together to aid in heat exchange while keeping the size of the tower side support to a minimum.

Figure 6:
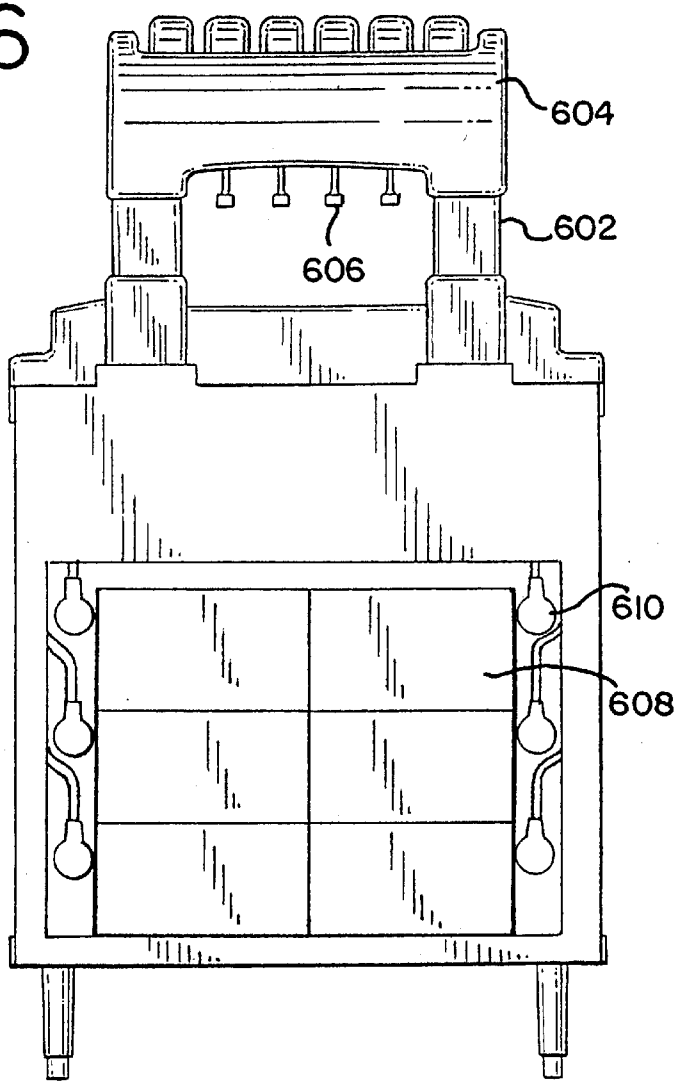
FIG. 6 is a rear view of a second embodiment of a low volume dispenser of the present invention.

FIG. 6 depicts a rear view of and alternative embodiment of a low volume dispenser 600. As viewed from the rear, parts visible include tower heat exchanger 602 and insulating cover 604, with serving actuators 606. In this view of the embodiment, the rear panel, bracket, pumps, and carbonator are not shown for the sake of clarity. In this embodiment, six bag-in-box (BIB) containers 608 of soft drink syrup are each equipped with a bag-in-box pump 610 for transporting syrup from the bag-in-box container to the tower for cooling and dispensing into the drink of a user.

While BIB containers may be used with pumps, the preferred embodiment of FIGS. 1–5 does not use syrup pumps. Instead, a mixing and dispensing valve which has the ability to draw syrup at least a short distance may be used. One such valve, disclosed in U.S. Pat. No. 5,476,193, uses the force of the carbonated water to drive a first piston for dispensing carbonated water, the first piston ganged to a driven piston in such a manner that the two pistons dispense a precisely adjusted ratio of water to syrup. The valve also may contain a nozzle for mixing and dispensing a drink. It is believed that a valve utilizing this basic design will be able to draw syrup from containers 214 and through tubing coils 438 for mixing with water to produce a beverage. Other valves may also be used, and they may be used with pumps, as in FIG. 6, or without pumps as described herein.

In one embodiment, a user dispenses a beverage by approaching the dispenser 100 and pressing a cup against lever 112. Pressing the lever activates the mixing and dispensing valve 108 by closing an internal switch (not shown) and activating a solenoid to open the valves. If a BIB pump is used, it is typically activated by the drop in pressure caused by opening the valve for the syrup. This activates the BIB pump 610 to pump syrup, providing a motive force for the syrup through the coils and ultimately through the mixing and dispensing valve. Carbon dioxide pressure from an outside source of carbon dioxide and the carbonator tank 203 and pump 205 provide motive force for the carbonated water through the coils and through the mixing and dispensing valve. Water pressure is typically sufficient to move non-carbonated water through the lines and through its coils, although a circulating pump 205 may also be used.

Figure 7:
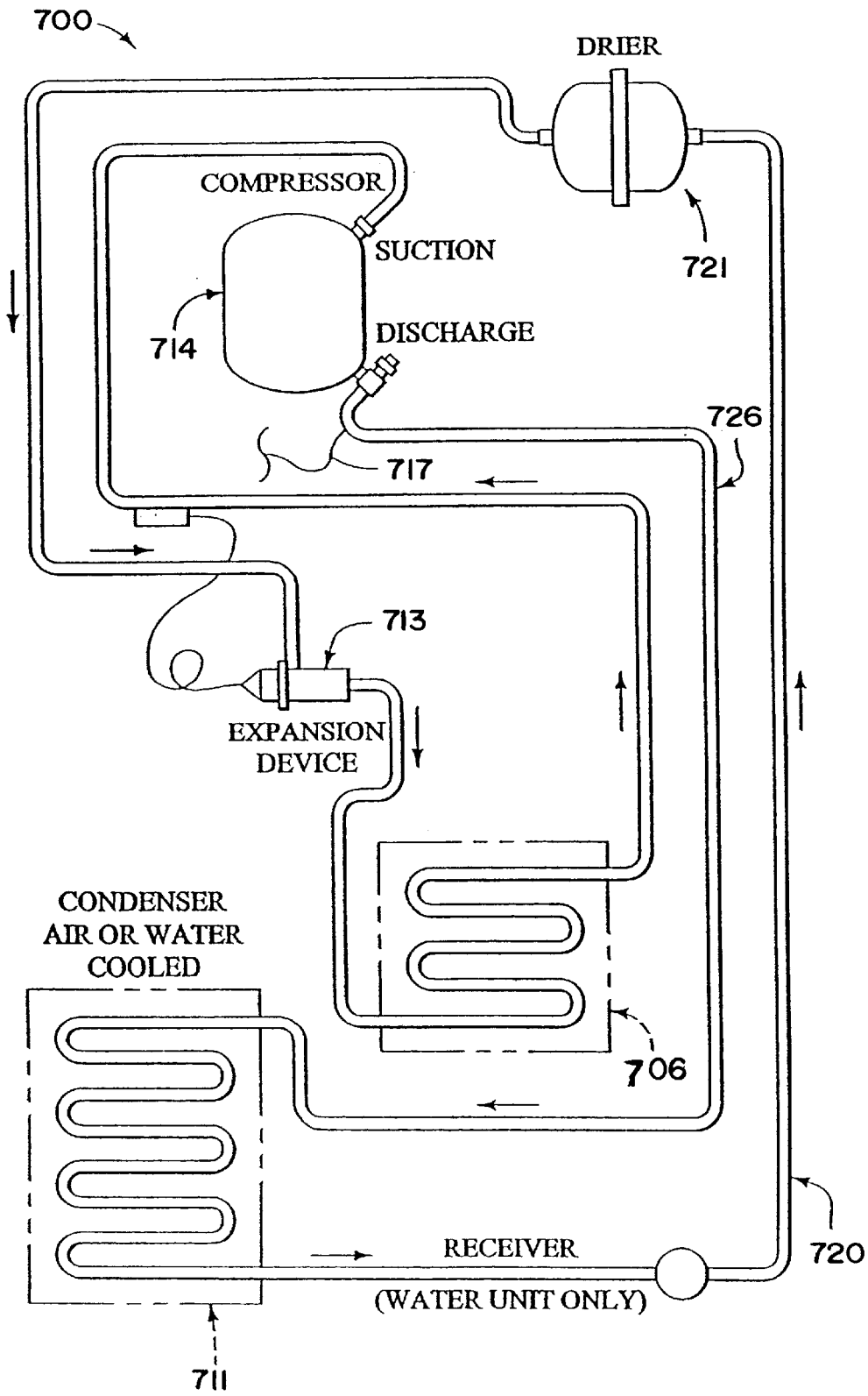
FIG. 7 is a schematic diagram of a refrigeration system used on a third embodiment of a low volume dispenser of the present invention.

FIG. 7 depicts a mechanical refrigeration system that may be used with the second heat exchanger 206 in the embodiment of FIG. 1. Instead of recirculating water, mechanical refrigeration is thus used to chill the beverage components in a second heat exchanger 706. In FIG. 7, the coolant/refrigerant system comprises a condenser 711, a heat exchanger 706 and a compressor 714. Heat exchanger 706 acts as an evaporator in a mechanical refrigeration system, as the place in which cooling takes place. The second heat exchanger 706 may include coils of syrup tubing and water tubing in an aluminum cold plate along with the tubing of the evaporator. FIG. 7 also illustrates a refrigerant supply line 720, a drier for the refrigerant 721, and an expansion device 713. The expansion device serves to lower the pressure of the liquid refrigerant. When the compressor 714 is operating, high temperature, high-pressure vaporous refrigerant is forced along a discharge line 726 back to the condenser 711. In one embodiment, a temperature sensor 717 is placed at the discharge of the compressor to monitor the temperature of the compressor discharge. The temperature sensor may be a thermistor or a thermocouple, or other temperature-sensing device.

There are many ways to practice this invention. As an example, the discussion above has focused on low volume beverage dispensers having six flavors. The method may be used for dispensers having only two flavors, or for three or four, or for more than six flavors. The figures depict a heat exchanger in two parts, for better efficiency, but a single, well-insulated heat exchanger will also work for exchanging heat between the water and the syrup, and rejecting the heat to the ice in the ice bin. A single ice bin is depicted, but two ice bins may also be used, such as one ice bin for dispensing ice for consumers of the beverages, and a separate ice bin for heat-rejection purposes. Embodiments featured have shown horizontal coils for the re-circulating carbonated water and vertical coils for the syrups and plain water; however, other embodiments may also be used, such as with vertical re-circulating loops and horizontal syrup loops. As is well known to those in the heat-exchange art, the coils may be arranged to provide more of a counter-current, cross-current or co-current flow. The arrangements depicted are the best way known to the inventors to package all the elements into a compact, inexpensive, and effective low volume beverage dispenser.

Figure 8:
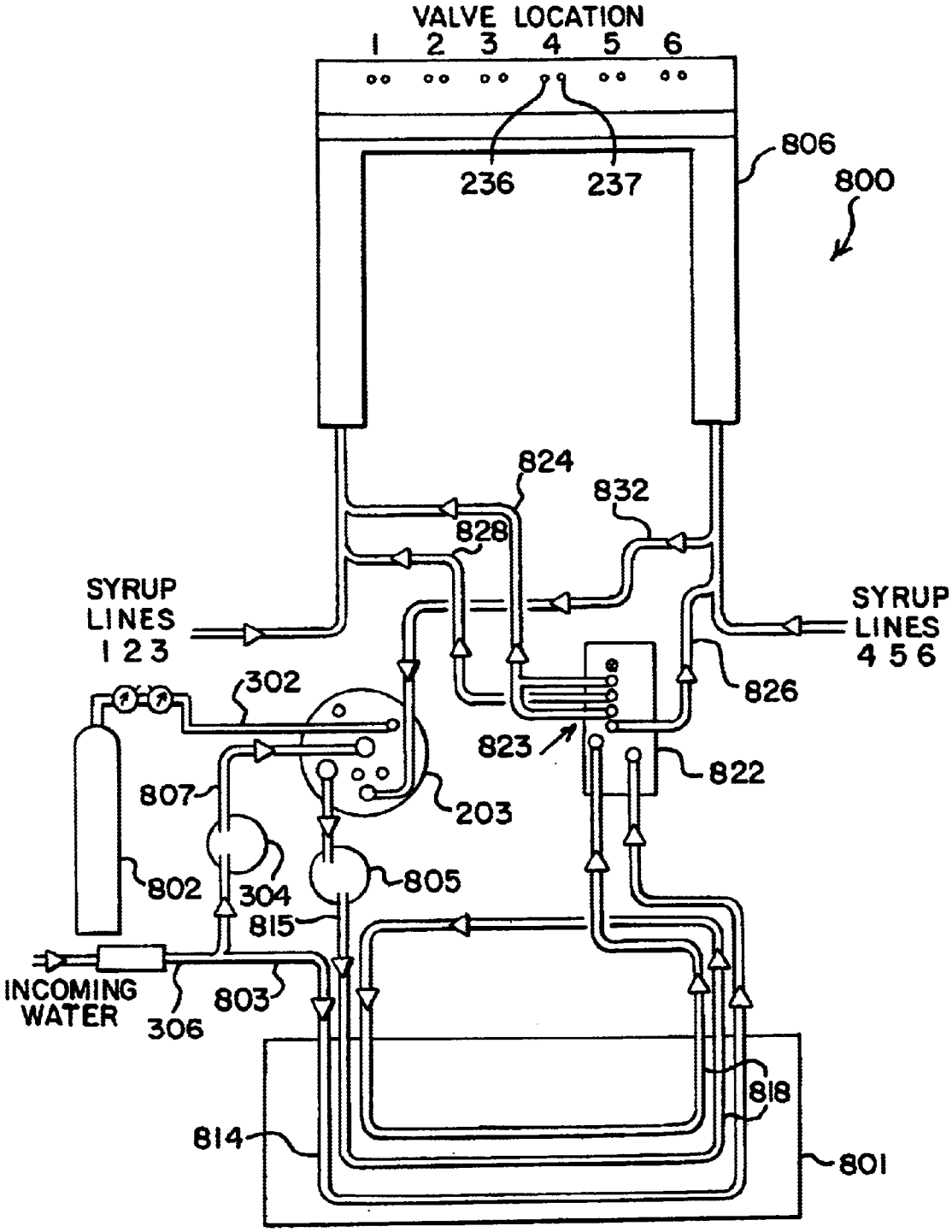
FIG. 8 is a schematic diagram of the water and syrup systems of a fourth embodiment of a beverage dispenser of the present invention using a selection manifold.

Another embodiment of the present invention, shown in FIG. 8, uses one or more selection manifolds to route carbonated and non-carbonated water to the appropriate positions and valves on the tower. A selection manifold typically has two inlets, such as carbonated and non-carbonated water, and a plurality of outlets, such as four or five. By manipulating valves and plugs within the manifold, each outlet is able to independently receive either carbonated water or non-carbonated water. If a change is desired in the routing, from non-carbonated water to carbonated water, or vice-versa, the change is accomplished quickly by an operator, rather than having to call a serviceman or a plumber. Selection manifolds are further described in patent application Serial No. 60/197,535, filed on Apr. 14, 2000, and entitled "Selection Manifold for Beverage Dispenser," and assigned to the assignee of the present invention, and which is hereby incorporated by reference. Any manifold that allows a user to select carbonated water or non-carbonated water for routing to the desired coils is meant to be included in the definition of manifold and in the claims below.

FIG. 8 also depicts an alternate arrangement for the water system, in that the water directed to the carbonation system is not prechilled. The components that may be common between the embodiments of FIGS. 1–5 and the embodiments of FIG. 8 carry the same reference numbers. In FIG. 8, an apparatus for dispensing soft drinks 800 includes a primary heat exchanger 801 and a tower heat exchanger 806. Water enters through a water-in line 306 and is directed by charge pump 304 to a carbonator tank 203 via line 807 and also to the primary heat exchanger 801 via inlet line 803. This non-carbonated water is then chilled via chilling coil 814 embedded within primary heat exchanger 801.

Carbon dioxide for carbonated water from small carbon dioxide storage tank 802 contained within the housing of the beverage dispenser enters carbonator tank 203 via carbon dioxide line 302. Water enters via line 807, and carbonated water is pumped out through line 815 by pump 805. The carbonated water is chilled by chilling coils 818 embedded in primary heat exchanger 801. Both carbonated water and non-carbonated water may be directed to selection manifold 822. As mentioned above, the selection manifold routes carbonated water or non-carbonated water to desired outlets 823 of the selection manifold. In this embodiment, two outlets are selected for carbonated water, two are selected for non-carbonated water, and one outlet is not used. Two outlets are selected for carbonated water and are routed through a carbonated water inlet line 824 to a cooling coil embedded in the tower heat exchanger 806. In this embodiment, the cooling coil chills the tower heat exchanger 806 and also provides carbonated water to valves in locations 1, 2, 5, and 6. The carbonated water returns via return line 832 to the carbonator for re-circulation.

Non-carbonated water from the selection manifold 822 has been selected for two of the outlets 823, for valve locations 3 and 4, and is routed via lines 826 and 828 to water cooling coils in the tower heat exchanger 806. The far ends of these coils 236, 237 are connected to mixing and dispensing valve locations 3 and 4. Non-carbonated water will not recirculate. Syrup for carbonated beverages is routed through syrup lines 1–6.

The tower heat exchanger 206 may have utility in other designs of beverage dispensers. For example, in high volume locations, a carbonator and syrup supplies may be housed in a back room. The carbonated water could be cooled by mechanical refrigeration, and the carbonated water and syrup delivered via an insulated trunk line to a tower heat exchanger 206 mounted on a countertop. The carbonated water, being continuously circulated, would keep the heat exchanger cold. The syrup would be cooled in coils embedded within the metallic body of the heat exchanger 206, and used to produce a very cold beverage. Rather than using the carbonated water as the circulating cooling fluid in such a system, another cooling fluid such as glycol, alcohol or even non-carbonated water could be used.

Beer may be dispensed along with soft drinks in another embodiment. In the valve used for beer, a different block valve is used and only a single line is needed to supply the valve. It is not necessary to use a cooling coil different from the syrup cooling coils described above. For instance, in one embodiment, a syrup cooling coil, such as S4, may be about ten feet long. If a beer container, such as a keg of beer is refrigerated, even a short coil will be sufficient to cool the beer as it passes from the refrigerated environment, to a non-chilled length of tubing, and then to the cooling coil embedded in a tower heat exchanger.

Figure 9:
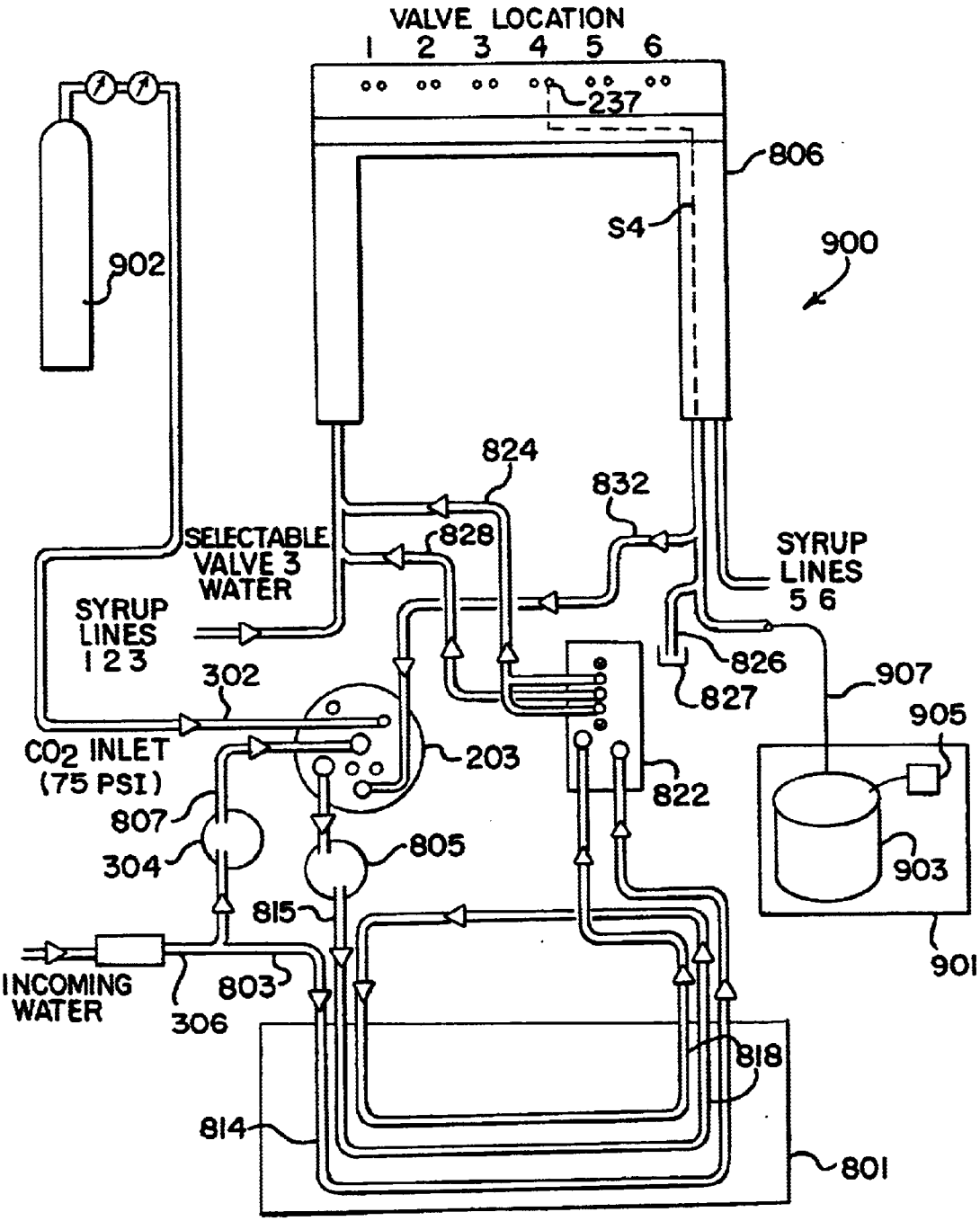
FIG. 9 is a schematic diagram of the water, syrup and beer systems of a fifth embodiment of the present invention.

FIG. 9 is an embodiment of a beverage dispenser 900 that dispenses both soft drinks and beer. All elements of the beverage dispenser are the same as in FIG. 8, except for the elements mentioned below. Carbon dioxide from tank 902 enters the beverage dispenser via carbon dioxide inlet line 302 and enters carbonator tank 203. Tank 902 may be located locally, e.g., close to the beverage dispenser, or may be located remotely, e.g., a back room in the general vicinity of the beverage dispenser. Selection manifold 822 has only one outlet carrying non-carbonated water, through line 828 to a selectable valve at location 3 and its mixing and dispensing nozzle 108 (not shown). Syrup line S4 is now used for beer, and line 826, formerly used for routing non-carbonated water to selectable valve at location 4, is now capped with cap 827. A keg of beer 903 is located at a short distance from the beverage dispenser 900 in a cooler 901. The cooler 901 is preferably equipped with a small compressor 905 for compressing air to propel beer through line 907 to line S4 and to the block valve and nozzle (not shown) that will be connected to syrup line S4 outlet 237. Line 907 is preferably insulated to keep the beer cold, and the line may not be cooled for at least part of its length between cooler 901 and its connection to syrup line S4.

Accordingly, it is the intention of the applicants to protect all variations and modifications within the valid scope of the present invention. It is intended that the invention be defined by the following claims, including all equivalents. While the invention has been described with reference to particular embodiments, those of skill in the art will recognize modifications of structure, materials, procedure and the like that will fall within the scope of the invention and the following claims.

What is claimed is:

1. A beverage dispenser, comprising:

a) a housing;

b) an ice bin within the housing;

c) space within the housing configured to receive at least one container of beverage syrup;

d) at least two seperate heat exchangers, a first heat exchanger in thermal contact with ice in the ice bin, said first heat exchanger exchanging heat with circulating water; and a second heat exchanger, spaced from the first heat exchanger, exchanging heat between the circulating water and the syrup;

e) a carbonator within the housing for making carbonated water; and f) at least one mixing and dispensing valve for mixing and dispensing carbonated water and syrup, wherein the dispenser is configured to receive ice, syrup, water and carbon dioxide and chill the water and syrup by exchanging heat with melting ice, and the mixing valve mixes the syrup and carbonated water and dispenses a soft drink.

2. The dispenser of claim 1 wherein the circulating water is carbonated water.

3. The dispenser of claim 1 further comprising a circulating pump for circulating water through said at least one heat exchanger.

4. The dispenser of claim 3 wherein the pump circulates carbonated water.

5. The dispenser of claim 1 further comprising a charging pump for charging water to the carbonator.

6. The dispenser of claim 1 further comprising at least one container of syrup within the housing.

7. The dispenser of claim 6 wherein the container of syrup is a bag-in-box (BIB) container.

8. The dispenser of claim 6 wherein the syrup in the container is subject only to atmospheric pressure and is drawn out of the container by reduced pressure downstream of the container.

9. The dispenser of claim 1 further comprising a block valve between said second heat exchanger and the at least one mixing valve.

10. The dispenser of claim 1 further comprising a plastic cover covering said second heat exchanger.

11. The dispenser of claim 1 wherein the second heat exchanger comprises an aluminum body containing separate flow passages for non-carbonated water, syrup, and carbonated water.

12. The dispenser of claim 11 wherein the passages comprise tubing around which aluminum is cast.

13. The dispenser of claim 1 wherein the second heat exchanger is in the shape of an inverted U.

14. The dispenser of claim 1 wherein the at least one heat exchanger comprises an aluminum cold plate containing separate flow passages for non-carbonated water and carbonated water.

15. The dispenser of claim 1 wherein the at least one heat exchanger is in the general shape of a flat plate.

16. The dispenser of claim 1 wherein the at least one heat exchanger is located so that ice in the ice bin sits on top of, and melts to cool, the at least one heat exchanger.

17. The dispenser of claim 1 further comprising at least one container of syrup in the housing and further comprising a pump for each container of syrup in the housing, and interconnecting lines between the pump and the second heat exchanger, and wherein activating a mixing and dispensing valve causes pumping of syrup into the valve and dispensing a soft drink mixed from said syrup.

18. The dispenser of claim 1 further comprising at least one mixing and dispensing valve connected to a source of non-carbonated water and dispensing a non-carbonated beverage.

19. The dispenser of claim 1 wherein the at least one mixing and dispensing valve comprise a volumetric ratio valve which draws syrup from a source of the syrup to the mixing valve.

20. The dispenser of claim 1 further comprising a carbon dioxide tank within the housing, said tank supplying carbon dioxide to the carbonator.

21. The dispenser of claim 1 further comprising a selection manifold between the at least one mixing and dispensing valve, and a source of water and a source of carbonated water.

22. A beverage dispenser, comprising:

a) a housing;

b) a carbonation system comprising a carbonator within the housing and a source of carbon dioxide;

c) a water system comprising a source of water, a charging pump for charging water to the carbonator, and a circulation pump for circulating water;

d) a source of syrup located in a space within the housing that is configured to receive at least one container of syrup;

e) a cooling system comprising an ice bin, a first heat exchanger for exchanging heat between ice in the ice bin and water and circulating carbonated water produced by the carbonation system, and a second heat exchanger seperate and spaced from the first heat exchanger for exchanging heat between said syrup and said circulating carbonated water; and f) a dispensing system comprising at least two mixing and dispensing valves and interconnecting lines between said valves, the source of water and the source of syrup; at least one of said two mixing and dispensing valves receiving syrup and carbonated water.

23. A beverage dispenser, comprising:

a) a housing;

b) an ice bin within the housing;

c) space within the housing configured to receive at least one container of beverage syrup, and at least one container of syrup within the housing, wherein the syrup is subject only to atmospheric pressure and is drawn out of the container by reduced pressure downstream of the container;

d) at least one heat exchanger within the housing in thermal contact with said ice bin;

e) a carbonator within the housing for making carbonated water; and f) at least one mixing and dispensing valve for mixing and dispensing carbonated water and syrup, wherein the dispenser is configured to receive ice, syrup, water and carbon dioxide and chill the water and syrup by exchanging heat with melting ice, and the mixing valve mixes the syrup and carbonated water and dispenses a soft drink.

24. A beverage dispenser, comprising:

a) a housing;

b) an ice bin within the housing;

c) space within the housing configured to receive at least one container of beverage syrup;

d) at least one heat exchanger within the housing in thermal contact with said ice bin;

e) a carbonator within the housing for making carbonated water; and f) at least one mixing and dispensing valve for mixing and dispensing carbonated water and syrup, wherein the at least one mixing and dispensing valve is a volumetric ratio valve which draws syrup from a source of the syrup to the mixing valve, and wherein the dispenser is configured to receive ice, syrup, water and carbon dioxide and chill the water and syrup by exchanging heat with melting ice, and the mixing valve mixes the syrup and carbonated water and dispenses a soft drink.

25. A beverage dispenser, comprising:

a) a housing;

b) an ice bin within the housing;

c) space within the housing configured to receive at least one container of beverage syrup;

d) at least one heat exchanger within the housing in thermal contact with said ice bin;

e) a carbonator within the housing for making carbonated water;

f) at least one mixing and dispensing valve for mixing and dispensing carbonated water and syrup; and g) a selection manifold between the at least one mixing and dispensing valve, and a source of water and a source of carbonated water, wherein the dispenser is configured to receive ice, syrup, water and carbon dioxide and chill the water and syrup by exchanging heat with melting ice, and the mixing valve mixes the syrup and carbonated water and dispenses a soft drink.

* * * * *